United States Patent [19]

Kobayashi et al.

[11] Patent Number: 4,586,480

[45] Date of Patent: May 6, 1986

[54] ELECTRONICALLY CONTROLLED DISTRIBUTOR TYPE FUEL INJECTION PUMP

[75] Inventors: Masayoshi Kobayashi; Shinya Nozaki; Keiichi Yamada; Tadashi Kobayashi, all of Higashimatsuyama, Japan

[73] Assignee: Diesel Kiki Co., Ltd., Tokyo, Japan

[21] Appl. No.: 673,362

[22] Filed: Nov. 20, 1984

[30] Foreign Application Priority Data

Nov. 26, 1983 [JP] Japan ..... 58-222762

[51] Int. Cl.[4] ..... F02M 39/00

[52] U.S. Cl. ..... 123/506; 123/503; 123/458; 417/494

[58] Field of Search ..... 123/503, 449, 506, 458, 123/500–502; 417/499, 500, 294, 494

[56] References Cited

U.S. PATENT DOCUMENTS

| | | | |
|---|---|---|---|
| 1,664,608 | 4/1928 | French | 123/506 |
| 3,724,436 | 4/1973 | Nagata | 123/506 |
| 4,385,614 | 5/1983 | Eheim | 123/506 |
| 4,413,600 | 4/1982 | Yanagawa | 123/503 |
| 4,449,504 | 5/1984 | Furuhashi | 123/449 |

FOREIGN PATENT DOCUMENTS

| | | | |
|---|---|---|---|
| 0102420 | 8/1979 | Japan | 123/449 |
| 57-91366 | 6/1982 | Japan | 123/503 |
| 0128428 | 8/1983 | Japan | 123/506 |

*Primary Examiner*—Carl Stuart Miller

*Attorney, Agent, or Firm*—Frishauf, Holtz, Goodman & Woodward

[57] ABSTRACT

A pair of cut-off ports are formed in a plunger and a plunger barrel at a predetermined axial location and registrable with each other to spill pressurized fuel into a zone under lower pressure. A communication passageway communicates a pump working chamber defined by the plunger at one end thereof with the zone under lower pressure. A solenoid valve is arranged across the communication passageway for blocking same. Control means controls the solenoid valve to cause same to selectively assume an open position and a closed position. While the plunger moves toward the pump working chamber, the solenoid valve is closed by the control means to start injection of fuel present in the pump working chamber, and upon registration of the cut-off ports with each other, the fuel injection is terminated.

6 Claims, 4 Drawing Figures

ELECTRONICALLY CONTROLLED DISTRIBUTOR TYPE FUEL INJECTION PUMP

BACKGROUND OF THE INVENTION

This invention relates to an electronically controlled distributor type fuel injection pump adapted for use in internal combustion engines, particularly in diesel engines.

Among conventional distributor type fuel injection pumps, an electronically controlled type is known, e.g. from Japanese Provisional Patent Publication No. 57-91366, wherein the fuel injection quantity and injection timing of the fuel injection pump is electrically controlled. According to this proposed type, a governor, an injection timing control device and a control sleeve are omitted from the fuel injection pump, but a single solenoid valve is employed instead for controlling the fuel injection quantity and the injection timing through its opening and closing actions, in such a manner that the fuel injection is initiated upon opening of the solenoid valve and terminated upon closing of the same valve. Therefore, the solenoid valve is required to have high responsiveness enough to achieve precise control of the fuel injection quantity and the injection timing. To this end, the solenoid valve should be capable of producing a large electromagnetic force. However, to produce such a large electromagnetic force, the solenoid valve inevitably has to be large in size, resulting in increased manufacturing cost as well as increased electric power consumption. Besides, the solenoid valve of the proposed type is constructed and arranged such that pressurized fuel acts upon the valve body in a direction of opening same, requiring a still larger electromagnetic force sufficient to overcome the pressure of the pressurized fuel so as to hold the valve body in its closed position. This also necessitates designing the solenoid valve to be large in size, further increasing the manufacturing cost as well as the electric power consumption.

SUMMARY OF THE INVENTION

It is an object of the invention to provide a distributor type fuel injection pump which is constructed such that the initiation of fuel injection alone is controlled by the solenoid valve while the termination of fuel injection is mechanically determined by the timing of registration of cut-off ports whereby high responsiveness is not required of the solenoid valve, thereby making it possible to employ an inexpensive and smallsized solenoid valve.

It is a further object of the invention to provide a distributor type fuel injection pump which requires only a small electromagnetic force for holding the solenoid valve in its closed position while imparting high responsiveness to the solenoid valve in its closing action, thereby making it possible to employ a solenoid valve which is inexpensive, small in size, and small in electric power consumption.

It is another object of the invention to provide a distributor type fuel injection pump which is capable of controlling with accuracy the fuel injection quantity even in small quantity region.

According to the present invention, a pair of cut-off ports are formed in a plunger and a plunger barrel at a predetermined axial location, and registrable with each other to spill pressurized fuel in the plunger into a zone under lower pressure. A communication passageway communicates a pump working chamber defined by the plunger at one end thereof with the zone under lower pressure, and a solenoid valve is arranged across the communication passageway for blocking same. Control means controls the solenoid valve to cause same to selectively assume an open position and a closed position. While the plunger moves toward the pump working chamber, the solenoid valve is closed by the control means to start injection of fuel present in the pump working chamber, and upon registration of the cut-off ports with each other, the fuel injection is terminated.

The solenoid valve comprises a valve body disposed opposite an end face of the one end of the plunger, a valve seat on which the valve body is seatable, urging means acting upon the valve body to bias same to the open position, and a solenoid energizable for biasing the valve body to the closed position against the force of the urging means. The valve body and the valve seat are arranged such that the valve body is kept off from the valve seat to assume the open position when it is biased toward the plunger, and is seated on the valve seat to assume the closed position when it is biased away from the plunger. The control means is adapted to selectively energize or deenergize the solenoid for causing the valve body to selectively assume the closed position or the open position.

The above and other objects, features and advantages of the invention will be more apparent from the ensuing detailed description taken in conjunction with the accompanying drawings.

DETAILED DESCRIPTION

Figure 1:
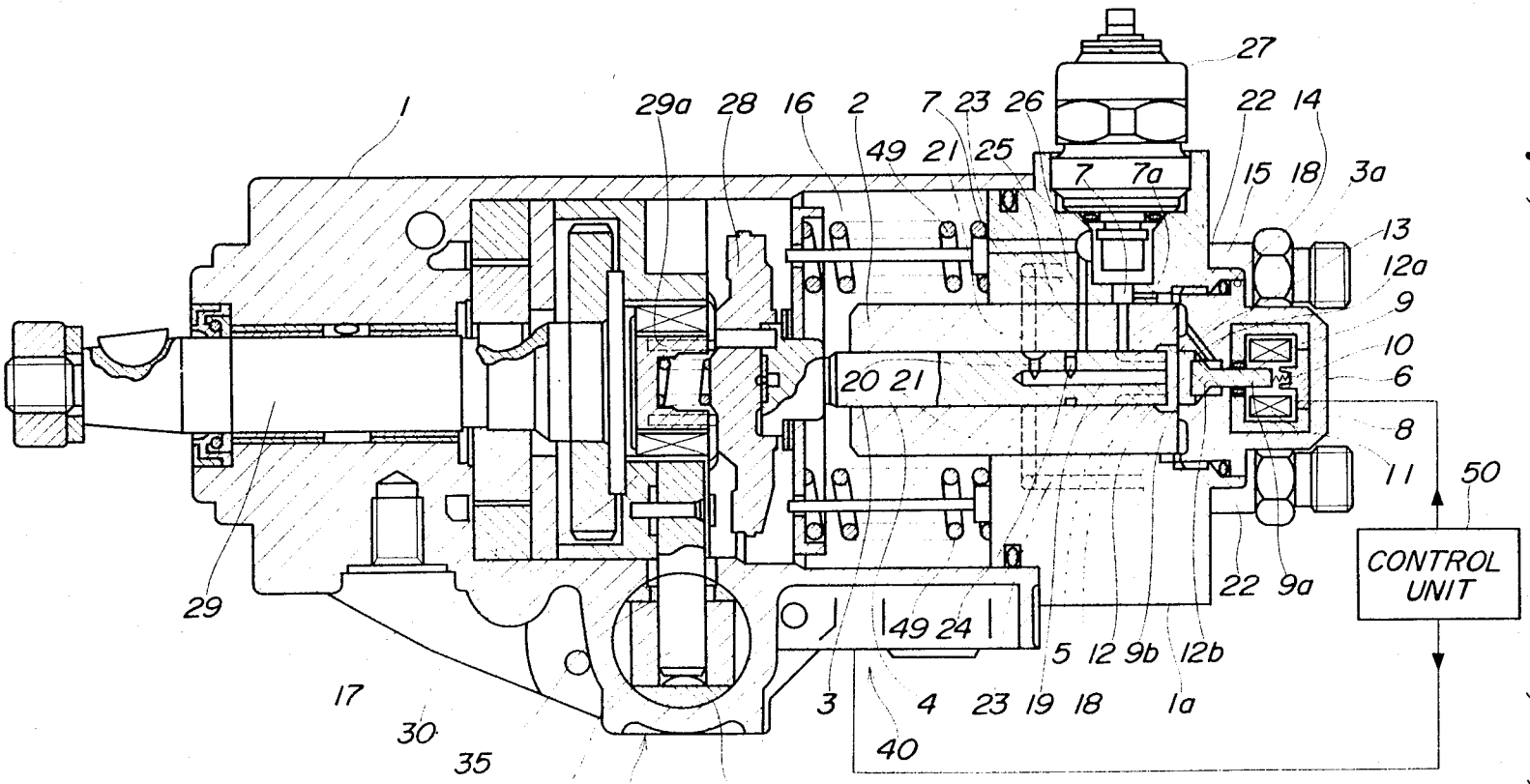
FIG. 1 is a longitudinal vertical sectional view of a distributor type fuel injection pump according to an embodiment of the invention.
Figure 2:
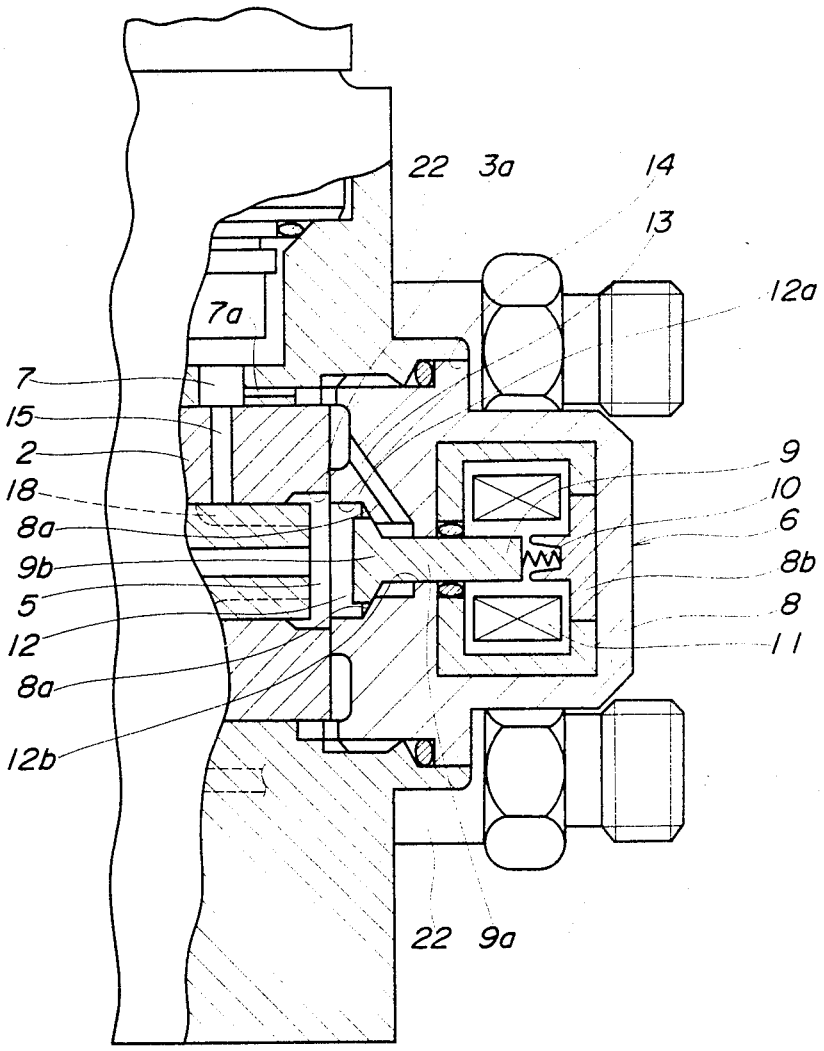
FIG. 2 is a fragmentary view, on an enlarged scale and partly in section, showing a solenoid valve for controlling the fuel injection quantity, appearing in FIG. 1, and its peripheral parts.

The invention will now be described in detail with reference to the drawings showing an embodiment thereof. Referring first to FIGS. 1 and 2, reference numeral 1 designates a pump housing of which a right end wall as viewed in FIG. 1 is formed by a wall member 1*a*. A plunger barrel 2 extends through a central portion of the wall member 1*a* and is formed therein with a cylinder bore 3 within which a plunger 4 is received for concurrent reciprocating and rotative motion therein for suction, pressure delivery and distribution of fuel. A pump working chamber 5 is defined by the cylinder bore 3 and the head or right end of the plunger 4, and disposed for communication via a solenoid valve 6 with a fuel suction passage 7 which in turn is communicated with a suction space 16 hereinafter referred to.

The solenoid valve 6 comprises a valve casing 8 formed integrally with a valve seat 8*a*, a piston-like valve body 9 arranged within the valve casing 8 for axial movement therein, a stator core 8*b* mounted within the valve casing 8, a spring 10 urging the valve body 9 toward its open position, and a solenoid 11 disposed to be energized or deenergized by a control unit 50, hereinafter referred to, to cause the valve body 9 to selectively assume its closed or open position. The spring 10 is interposed between an end face of the valve body 9 remote from its valve head 9*b* and an inner end face of the stator core 8*b*.

The valve casing 8 is formed therein with a valve bore 12 extending along its axis, and a communication passage 13 extending obliquely from an inner peripheral surface of the bore 12 to communicate the pump working chamber 5 with the fuel suction passage 7 through the bore 12 when the valve body 9 is open. The communication passage 13 is connected to the fuel suction passage 7 through an auxiliary passage 7*a* formed in the wall member 1*a* of the pump housing 1. The valve bore 12 comprises a valve head-fitting bore 12*a* opening in one end face of the valve casing 8 and defining part of the pump working chamber 5, a valve stem-fitting bore 12*b* having a diameter smaller than that of the valve head-fitting bore 12*a* axially aligned therewith and communicating with the communication passage 13, and the valve seat 8*a* in the form of a tapered annulus interposed between the bores 12*a*, 12*b*. The valve head-fitting bore 12*a* has almost the same diameter as that of the cylinder bore 3.

The valve casing 8 is secured to the pump housing 1 with its outer peripheral surface threadedly fitted into a fitting opening 14 formed in one end face of the wall member 1*a* adjacent to an outer end of the plunger barrel 2. With the valve casing 8 thus mounted on the pump housing 1, the cylinder bore 3 is connected at its enlarged open end 3*a* with an open end of the valve head-fitting bore 12*a* in axial alignment therewith, whereby the pump working chamber 5 is defined by the end face of the head of the plunger 4, an inner peripheral surface of the cylinder bore 3 at its enlarged open end 3*a*, and an inner peripheral surface of the valve head-fitting bore 12*a*.

The valve body 9 has a valve head 9*b* of a generally triangular cross section corresponding to a seating surface of the valve seat 8*a*, integrally formed with the valve stem 9*a* at its one end and having a diameter larger than that of the valve stem 9*a*. The valve body 9 has its valve stem 9*a* and valve head 9*b* located, respectively, in the valve stem-fitting bore 12*b* and the valve head-fitting bore 12*a* for axial movement therein through a predetermined stroke with respect to its seated position where the valve head 9*b* is seated on the valve seat 8*a*.

With the valve body 9 thus fitted in the bore 12, one end face of the valve head 9*b* remote from the valve stem 9*a* is disposed opposite the corresponding end face of the plunger head. When the valve body 9 moves away from the valve seat 8*a* toward the plunger 4, communication is established between the pump working chamber 5 and the communication passage 13 through the open valve body 9, and accordingly between the pump working chamber 5 and the fuel suction passage 7. On the other hand, when the valve body 9 moves away from the plunger 4 and becomes seated on the valve seat 8*a*, the pump working chamber 5 is disconnected from the communication passage 13 by the closed valve body 9, and thus the communication is interrupted between the pump working chamber 5 and the fuel suction passage 7. The valve body 9 is provided with a stopper, not shown, for prohibiting displacement of same from the seated position toward the plunger 4 over the predetermined stroke.

The solenoid 11 of the solenoid valve 6 is accommodated within the valve casing 8 and electrically connected to the control unit 50, to be energized by an injection starting command signal from the control unit 50 to bring the valve body 9 into its closed position against the urging force of the spring 10.

The fuel suction passage 7 communicates at one end with a suction port 15 formed through a peripheral wall of the plunger barrel 2 at a location adjacent the pump working chamber 5, and opens at the other end into the suction space 16 defined within the pump housing 1. The suction space 16 is connected to a fuel tank, not shown, via a fuel pump, not shown, and a feed pump 17 arranged in the pump housing 1, to be supplied with pressurized fuel. The feed pump 17 is disposed around a drive shaft 29 extending through an end wall of the pump housing 1 remote from the pump working chamber 15, to be driven by same.

The head of the plunger 4 has its outer peripheral surface formed with a plurality of circumferentially equidistant suction slits 18 which are disposed to sequentially register with the suction port 15 as the plunger 4 rotates.

The plunger 4 has its interior formed with a central bore 19 extending along its axis from the end face of the plunger head to an intermediate portion of the plunger 4. A first discharge port 20 is formed in the plunger 4 and communicates with the axial central bore 19. A plurality of second discharge ports 21, which are equal in number to cylinders of an internal combustion engine associated with the pump, are formed in the peripheral wall of the plunger barrel 2 in a manner circumferentially equidistantly spaced from each other. The first discharge port 20 is disposed to sequentially register with the second discharge ports 21 as the plunger 4 rotates. The second discharge ports 21 communicate through respective ones of discharge passages 23 formed in the pump housing 1 with the inlets of delivery valves 22 arranged at one end face of the pump housing 1 associated with the solenoid valve 6, and equal in number to the second discharge ports 21. The delivery valves 22 are connected at their outlets to respective ones of injection nozzles, not shown.

A first cut-off port 24 is formed in the peripheral wall of the plunger 4 at a predetermined axial location between the suction slits 18 and the first discharge port 20 and communicates with the central bore 19. A second cut-off port 25 is formed in the peripheral wall of the plunger barrel 2 at a predetermined axial location between the suction port 15 and the second discharge ports 21. The first cut-off port 24 is disposed to register with the second cut-off port 25 to terminate fuel injection while the plunger 4 is moving through the delivery stroke.

The second cut-off port 25 communicates with the fuel suction passage 7 through a cut-off passage 26 formed in the pump housing 1. A fuel-cut valve 27, which is formed of a solenoid valve, is arranged across the fuel suction passage 7 and adapted to be energized during operation of the fuel injection pump to communicate the fuel suction passage 7 with the suction port 15, and deenergized to block the fuel suction passage 7 for promptly stopping the operation of the fuel injection pump.

A cam disc 28 is secured to the plunger 4 at its one end remote from the pump working chamber 5, and connected to the drive shaft 29 via an Oldham's coupling 29*a* in a manner permitting axial movement of the cam disc 28 relative to the drive shaft 29 but prohibiting circumferential movement of the former relative to the latter. Thus, the plunger 4 is driven through the cam disc 28 by the drive shaft 29 which is in turn rotatively driven by the engine. As the drive shaft 29 rotates, the plunger 4 is caused to concurrently make a rotative motion in unison with the cam disc 28 and a reciprocating motion within the cylinder bore 3 which is caused by the rolling motions of rollers, not shown, of a roller holder 30 over a camming surface of the cam disc 28.

An injection timing control device 31 is arranged beneath the roller holder 30, in which a timer piston 32 is connected to the roller holder 30 via a connecting lever 33.

Figure 3:
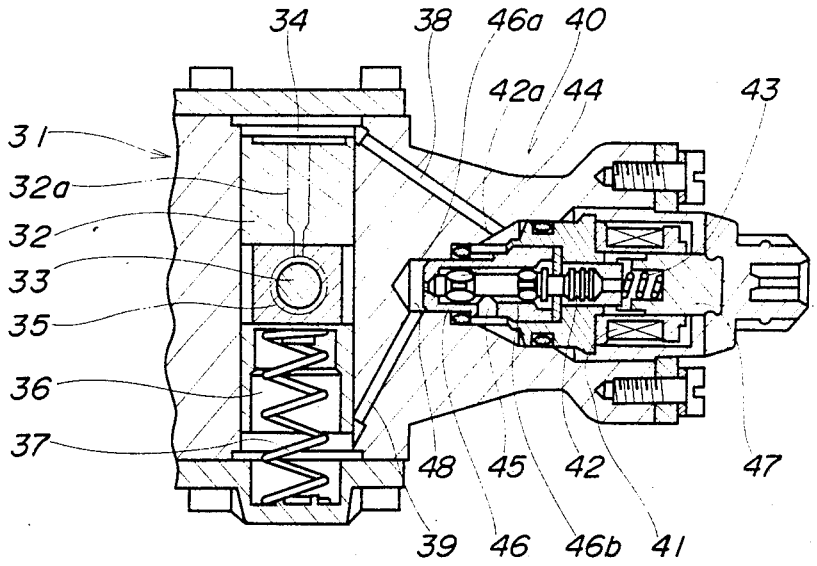
FIG. 3 is a longitudinal horizontal sectional view showing details of an injection timing control device appearing in FIG. 1.

FIG. 3 illustrates details of the injection timing control device 31. A high pressure chamber 34 defined at one end of the timer piston 32 is communicated with the pump working chamber 5 in FIGS. 1 and 2, through an oil passage 32*a* formed in the timer piston 32, and a bore 35 formed in the timer piston 32 at a junction of the connecting lever 33 with the timer piston 32. Therefore, a fuel pressure corresponding to the rotational speed of the engine is supplied to the high pressure chamber 34 from the suction space 16.

A low pressure chamber 36 defined at the other end of the timer piston 32 is connected to a low pressure suction side of the feed pump 17 in FIG. 1, through an oil passage, not shown. A timer spring 37 is disposed within the low pressure chamber 36 and urges the timer piston 32 toward the high pressure chamber 34.

The injection timing control device 31 is further provided with a solenoid valve 40 for controlling the oil pressure within the high pressure chamber 34, which is arranged between an oil passage 38 connected to the high pressure chamber 34, and an oil passage 39 connected to the low pressure chamber 36, to establish and interrupt the communication between the oil passages 38, 39. The solenoid valve 40 comprises a solenoid 41, a spool valve body 42 responsive to energization of the solenoid 41, a stator core 47, a valve casing 46 having a through hole 46*a* formed in its end wall and a bore 46*b* formed therein for slidably receiving the spool valve body 42, and a spring 43 interposed between the spool valve body 42 and the stator core 47 and urging the valve body 42 toward its closed position, i.e. in a direction of closing the through hole 46*a*.

When electric current flows to the solenoid valve 40 to energize the solenoid 41, the spool valve body 42 is caused to move rightward as viewed in FIG. 2 to open against the urging force of the spring 43, thereby communicating the oil passages 38, 39 with each other through an annular groove 44, an oil hole 45, axial grooves 42*a* of the spool valve body 42, the through hole 46*a* and a space 48. On the other hand, when the flow of electric current is interrupted to deenergize the solenoid 41, the spool valve body 42 is displaced leftward by the force of the spring 43 to disconnect the oil passages 38, 39 from each other.

The control unit 50 is adapted to determine the fuel injection quantity in dependence on the rotational speed, loaded condition and temperature of the engine, etc. for supplying the solenoid 11 of the solenoid valve 6 with the injection starting command signal with timing corresponding to the determined injection quantity, and also determine the amount of advancement of the plunger, i.e. the initial circumferential position of same, in dependence on the engine speed, the fuel injection quantity, etc. for supplying the solenoid valve 40 with a driving signal with a duty ratio corresponding to the determined advancement amount of the plunger, as hereinafter described.

The operation of the distributor type fuel injection pump constructed as above will now be described with reference to FIG. 4, which shows the operation of the fuel injection pump in the form of a timing chart wherein the curve I denotes the opening area of the suction port 15, II the opening area of the discharge port 20, III the lift of the plunger 4 or the cam disc, IV the area of registration between the cut-off ports 24, 25, and V driving pulses for the solenoid valve 6, respectively. When the plunger 4 is in its left extreme position while making concurrent rotative and reciprocating motions, fuel pressurized by the feed pump 17 has been introduced into the pump working chamber 5 and the solenoid valve 6 is open (the time period 0−t1 in FIG. 4).

Then, the plunger 4 starts to lift toward the pump working chamber 5 as indicated by a of the curve III, and the suction port 15 is closed by the outer peripheral surface of the plunger 4 (b of the curve I) for pressurizing fuel. On this occasion, however, the valve body 9 of the solenoid valve 6 is in its open state (c of the line V) so that the fuel in the pump working chamber 5 can escape through the communication passage 13 and the fuel suction passage 7 to the suction space 16 of the pump housing 1, and accordingly the fuel pressure in the chamber 5 does not increase enough to be injected (the time period t1−t2).

Figure 4:
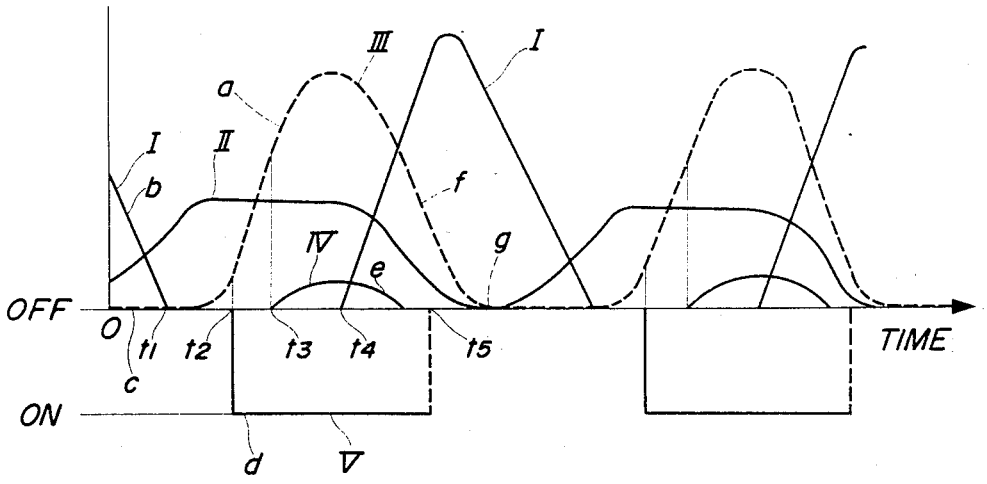
FIG. 4 is a timing chart showing the relationship in timing between opening and closing of the solenoid valve, registration of the cut-off ports, lifting of the plunger, and changes in the opening areas of the suction port and the discharge port.

When the plunger 4 moves through a suitable stroke toward the pump working chamber 5 from its initial or left extreme position, the solenoid 11 of the solenoid valve 6 is energized by the injection starting command signal supplied from the control unit 50 (e of the line V), to cause the valve body 9 to move away from the plunger 4 against the urging force of the spring 10 to become closed, thereby disconnecting the pump working chamber 5 from the fuel suction passage 7 (t2 in FIG. 4). As the plunger 4 further moves toward the pump working chamber 5, the fuel in the pump working chamber 5 and the plunger 4 is pressurized to a higher pressure and flows through the central bore 19, the discharge ports 20, 21 and the discharge passages 23 to the delivery valves 22 to sequentially open same against the urging forces of respective springs, not shown, urging the delivery valves 22 toward their closed positions. The fuel is then injected into the combustion chambers of the engine cylinders through the injection nozzles (the time period t2−t3).

As the plunger 4 further moves toward the pump working chamber 5 into a position in the vicinity of its right extreme position, the cut-off port 24 of the plunger 4 becomes registered with the cut-off port 25 of the plunger barrel 2 (t3; e of the curve IV). Therefore, the fuel pressure in the plunger 4 and the pump working chamber 5 is reduced as fuel spills through the cut-off ports 24, 25, the cut-off passage 26 and the fuel suction passage 7 into the suction space 16 of the pump housing 1, thereby terminating the pressure delivery of fuel to the delivery valves.

While the plunger 4 moves away from the pump working chamber 5 after termination of the fuel injection (f of the curve III), pressurized fuel in the suction space 16 starts flowing into the pump working chamber 5 through the fuel suction passage 7, the suction port 15 and the suction slits 18 (c in FIG. 4), upon communication of each of the suction slits 18 of the plunger 4 with the suction port 15 of the plunger barrel 2 (t4 in FIG. 4).

Thereafter, the plunger 4 returns to its left extreme position (g of the curve III). While the plunger 4 moves from the right extreme position to the left extreme position, the control unit 50 supplies an injection terminating command signal to the solenoid valve 6 to deenergize the solenoid 11 (t5 in FIG. 4). Accordingly, the valve body 9 is biased to its open position by the urging force of the spring 10, to thereby communicate the pump working chamber 5 with the fuel suction passage 7 through the communication passage 13 and the auxiliary passage *7a*, terminating the fuel injection.

The initiation of fuel injection is determined by the timing of closing the solenoid valve 6, as described above, and therefore, the earlier the closing of the solenoid valve 6 during movement of the plunger 4 toward the pump working chamber 5 from the left extreme position, the larger the fuel injection quantity becomes.

To control the fuel injection timing, the injection timing control device 31 and the solenoid valve 40 are controlled in the following manner: The duty ratio of opening and closing the solenoid valve 40 is determined in dependence upon the fuel injection quantity, i.e. the timing of closing the solenoid valve 6, and the engine rotational speed. That is, the duty ratio of the solenoid valve 40 is set to such values that the plunger can always assume initial circumferential positions required to achieve a predetermined desired injection timing curve dependent upon the engine speed, irrespective of changes in the closing timing of the solenoid valve 6 corresponding to changes in the fuel injection quantity. For instance, when the fuel injection quantity is small, the duty ratio of the control valve 40 is set to relatively small values corresponding to respective different values of the engine speed so that the leakage amount of fuel from the high pressure chamber 34 to the low pressure chamber 36 becomes small to cause the plunger to assume relatively large advanced positions or initial circumferentially biased positions. On the other hand, when the fuel injection quantity is large, the duty ratio of the valve 40 is set to relatively large values corresponding to respective different values of the engine speed, whereby only small amounts of fuel is leaked from the high pressure chamber 34 to the low pressure chamber 36 to thereby obtain relatively small advanced positions of the plunger.

The fuel injection pump of the present invention, constructed as above, provides the following advantageous effects:

(i) The initiation of the fuel injection alone is controlled by the solenoid valve 6, while the termination of the fuel injection is controlled in a mechanical manner as conventionally employed, by means of the cut-off ports 25, 26, which does not require the solenoid valve 6 to have high responsiveness in its opening and closing action;

(ii) The solenoid valve 6 is constructed and arranged such that the pressure of fuel in the pump working chamber 5 acts upon the valve body of the solenoid valve in a direction of closing same, which does not require the solenoid to produce a large electromagnetic force for holding the valve body in its closed position, imparting high responsiveness to the solenoid valve 6 in its closing action. Therefore, in cooperation with the effect (i) described above, an inexpensive and small-sized solenoid valve can be employed, which consumes small electric power;

(iii) Small injection quantity control can be achieved by merely retarding the timing of closing the solenoid valve 6 so as to make the same closing timing closer to the timing of registration of the cut-off ports, thereby permitting the valve body of the solenoid valve to lift through its whole stroke. This enables the small injection quantity control to be positively performed with ease, while overcoming the disadvantage of inaccurate small injection quantity control with the conventional arrangement referred to before, wherein the fuel injection quantity is determined by the opening and closing timing of the solenoid valve; and (iv) No control sleeve, usually employed in conventional distributor type fuel injection pumps, is employed, affording space for additional plunger springs 49 which urge the plunger 4 in a direction away from the pump working chamber 5, i.e. more than two. This enables adjusting with ease the setting force of the plunger springs over a wide range of values dependent on the kind of an engine to be employed.

While a preferred embodiment of the invention has been described, variations thereto will occur to those skilled in the art within the scope of the present inventive concepts which are delineated by the appended claims.

What is claimed is:

1. A distributor type fuel injection pump comprising:

a plunger barrel;

a plunger received within said plunger barrel for concurrent reciprocating and rotative motion for suction, pressure delivery and distribution of fuel;

a pair of cut-off ports formed in said plunger and said plunger barrel at a predetermined axial location and registrable with each other to spill pressurized fuel in said plunger into a zone under lower pressure;

a communication passageway communicating a pump working chamber defined by said plunger at one end thereof with said zone under lower pressure;

a fuel suction passage extending between said pump working chamber and said zone under lower pressure;

said communication passageway extending between said pump working chamber and an intermediate portion of said fuel suction passage;

a solenoid valve arranged across said communication passageway for blocking same; and control means for controlling means for controlling said solenoid valve to cause same to selectively assume an open position and a closed position;

wherein while said plunger moves toward said pump working chamber, said solenoid valve is closed by said control means to start injection of fuel present in said pump working chamber, and upon registration of said cut-off ports with each other, the fuel injection is terminated;

said solenoid valve including a valve body disposed opposite an end face of said one end of said plunger, a valve seat on which said valve body is seatable, said valve body and said valve seat being arranged such that said valve body is kept off from said valve seat to assume said open position when it is biased toward said plunger, and is seated on said valve seat to assume said closed position when it is biased away from said plunger, urging means acting upon said valve body to bias same to said open position, and a solenoid energizable for biasing said valve body to said closed position against the force of said urging means;

said control means including means for selectively energizing or deenergizing said solenoid for causing said valve body to selectively assume said closed position or said open position.

2. A distributor type fuel injection pump comprising:

a plunger barrel;

a plunger received within said plunger barrel for concurrent reciprocating and rotative motion for suction, pressure delivery and distribution of fuel;

a pair of cut-off ports formed in said plunger and said plunger barrel at a predetermined axial location and registrable with each other to spill pressurized fuel in said plunger into a zone under lower pressure;

a communication passageway communicating a pump working chamber defined by said plunger at one end thereof with said zone under lower pressure;

a fuel suction passage extending between said pump working chamber and said zone under lower pressure;

said cut-off port formed in said plunger barrel communicating with said fuel suction passage at an intermediate portion thereof;

a solenoid valve arranged across said communication passageway for blocking same; and control means for controlling means for controlling said solenoid valve to cause same to selectively assume an open position and a closed position;

wherein while said plunger moves toward said pump working chamber, said solenoid valve is closed by said control means to start injection of fuel present in said pump working chamber, and upon registration of said cut-off ports with each other, the fuel injection is terminated;

said solenoid valve including a valve body disposed opposite an end face of said one end of said plunger, a valve seat on which said valve body is seatable, said valve body and said valve seat being arranged such that said valve body is kept off from said valve seat to assume said open position when it is biased toward said plunger, and is seated on said valve seat to assume said closed position when it is biased away from said plunger, urging means acting upon said valve body to bias same to said open position, and a solenoid energizable for biasing said valve body to said closed position against the force of said urging means;

said control means including means for selectively energizing or deenergizing said solenoid for causing said valve body to selectively assume said closed position or said open position.

3. A distributor type fuel injection pump as claimed in claim 2, including a pump housing; and wherein said solenoid valve has a valve casing mounted on said pump housing opposite one end of said plunger barrel; said valve body, said urging means and said solenoid being accommodated within said valve casing; said valve casing having formed therein a first bore defining part of said pump working chamber, a second bore arranged in axial alignment with said first bore and having a diameter smaller that that of said first bore, and a valve seat interposed between said first bore and said second bore; said valve body having a valve head located in said first bore and seatable on said valve seat, and a valve stem formed integrally with said valve head and located in said second bore; said communication passage having part thereof formed in said valve casing and opening into said second bore.

4. A distributor type fuel injection pump as claimed in claim 3, wherein said valve seat comprises a tapered annular valve seat; and said valve head of said valve body has a generally triangular cross section corresponding to a seating surface of said valve seat.

5. A distributor type fuel injection pump as claimed in claim 1, including a pump housing; and wherein said solenoid valve has a valve casing mounted on said pump housing opposite one end of said plunger barrel; said valve body, said urging means and said solenoid being accommodated within said valve casing; said valve casing having formed therein a first bore defining part of said pump working chamber, a second bore arranged in axial alignment with said first bore and having a diameter smaller than that of said first bore, and a valve seat interposed between said first bore and said second bore; said valve body having a valve head located in said first bore and seatable on said valve seat, and a valve stem formed integrally with said valve head and located in said second bore; said communication passage having part thereof formed in said valve casing and opening into said second bore.

6. A distributor type fuel injection pump as claimed in claim 5, wherein said valve seat comprises a tapered annular valve seat; and said valve head of said valve body has a generally triangular cross section corresponding to a seating surface of said valve seat.

* * * * *